US011666957B2

(12) United States Patent
Sondermann et al.

(10) Patent No.: US 11,666,957 B2
(45) Date of Patent: Jun. 6, 2023

(54) CONTROLLING A STRIP TENSION DURING THE FLEXIBLE ROLLING OF METAL STRIP

(71) Applicant: Muhr und Bender KG, Attendorn (DE)

(72) Inventors: Andre Sondermann, Finnentrop (DE); Andre Feldmann, Olpe (DE); Alexander Eick, Plettenberg (DE); Harald Eichner, Hennef (DE); Martin Böhmer, Finnentrop (DE)

(73) Assignee: Muhr und Bender KG, Attendorn (DE)

( * ) Notice: Subject to any disclaimer, the term of this patent is extended or adjusted under 35 U.S.C. 154(b) by 0 days.

(21) Appl. No.: 17/265,831

(22) PCT Filed: Jul. 20, 2019

(86) PCT No.: PCT/EP2019/069604

§ 371 (c)(1),
(2) Date: Feb. 4, 2021

(87) PCT Pub. No.: WO2020/035261

PCT Pub. Date: Feb. 20, 2020

(65) Prior Publication Data

US 2021/0291244 A1 Sep. 23, 2021

(30) Foreign Application Priority Data

Aug. 15, 2018 (EP) ..... 18189152

(51) Int. Cl.
*B21B 37/50* (2006.01)
*B21B 39/08* (2006.01)

(52) U.S. Cl.
CPC ..... *B21B 37/50* (2013.01); *B21B 39/084* (2013.01); *B21B 2265/02* (2013.01)

(58) Field of Classification Search
CPC ..... B21B 37/48; B21B 37/50; B21B 39/08; B21B 39/084; B21B 2265/02
See application file for complete search history.

(56) References Cited

U.S. PATENT DOCUMENTS

2011/0302976 A1* 12/2011 Keintzel ..... B21B 37/00 72/13.3

FOREIGN PATENT DOCUMENTS

CN 101890434 A 11/2010
CN 103722026 A 4/2014
(Continued)

OTHER PUBLICATIONS

International Search Report and Written Opinion for PCT/EP2019/069604 dated Sep. 19, 2019 (14 pages; with English translation).

*Primary Examiner* — Teresa M Ekiert
(74) *Attorney, Agent, or Firm* — Bejin Bieneman PLC

(57) ABSTRACT

An apparatus for controlling a strip tension during flexible rolling of metal strip comprises a roll arrangement with at least one dancer roll, the position of said dancer roll being adjustable for controlling the strip tension of the metal strip, at least one hydraulic drive coupled to the dancer roll for adjusting the dancer roll, a hydraulic tank for hydraulic fluid, which is fluidly connected to the hydraulic drive via a hydraulic supply line, a controllable valve arrangement between the hydraulic tank and the hydraulic drive for controlling the hydraulic drive, a hydraulic pump with which the hydraulic drive is supplied with hydraulic fluid from the hydraulic tank, and at least one hydraulic pressure accumulator for temporarily storing hydraulic fluid previously delivered by the hydraulic pump, the hydraulic pressure accumulator being arranged between the hydraulic pump and the valve arrangement,
(Continued)

wherein a pressure sensor is arranged in the hydraulic drive for determining the hydraulic pressure.

4 Claims, 1 Drawing Sheet

(56) References Cited

FOREIGN PATENT DOCUMENTS

| | | | | | |
|---|---|---|---|---|---|
| DE | 10315357 | A1 | | 11/2004 | |
| EP | 1281450 | A2 | | 2/2003 | |
| EP | 1454681 | A2 | | 9/2004 | |
| EP | 1121990 | B2 | | 2/2012 | |
| GB | 1165475 | A | | 10/1969 | |
| JP | H01205815 | A | | 8/1989 | |
| JP | 10034204 | A | * | 2/1998 | ..... B21B 37/48 |
| JP | 2004308796 | A | | 11/2004 | |
| WO | 03008122 | A1 | | 1/2003 | |

* cited by examiner

CONTROLLING A STRIP TENSION DURING THE FLEXIBLE ROLLING OF METAL STRIP

CROSS-REFERENCE TO RELATED APPLICATIONS

This application is a national stage of, and claims priority to, Patent Cooperation Treaty Application No. PCT/EP2019/069604, filed on Jul. 20, 2019, which application claims priority to European Application No. EP 18189152.4, filed on Aug. 15, 2018, which applications are hereby incorporated herein by reference in their entireties.

INTRODUCTION

The present disclosure relates to an apparatus, a rolling mill comprising such an apparatus and a method for controlling a strip tension in flexible rolling of metal strip, wherein the apparatus comprises a roll arrangement with at least one dancer roll, the position of said dancer roll being adjustable for controlling the strip tension of the metal strip. Further, the apparatus comprises at least one hydraulic drive coupled to the dancer roll for adjusting the dancer roll, and a hydraulic tank for hydraulic fluid fluidly connected to the hydraulic drive via a hydraulic supply line. A controllable valve arrangement is disposed between the hydraulic tank and the hydraulic drive for controlling the hydraulic drive. The hydraulic drive is supplied with hydraulic fluid from the hydraulic tank by means of a hydraulic pump. The apparatus further comprises at least one hydraulic pressure accumulator for temporarily storing hydraulic fluid previously delivered by the hydraulic pump, the hydraulic pressure accumulator being disposed between the hydraulic pump and the valve arrangement.

BACKGROUND

An apparatus for flexible rolling of a metal strip is shown in GB 1 165 475 A. In the apparatus shown there, during the rolling process the valve arrangement is transferred to a neutral position in which both chambers of the hydraulic cylinder are connected to the pressure storage for moving the roll. Thus, a constant pressure is applied to the hydraulic cylinder and the roll is pressed against the strip with a constant force. The force exerted by a piston rod of the hydraulic cylinder is set depending on the difference between a piston rod-side surface and a cylinder chamber-side surface of a piston of the hydraulic cylinder.

By means of the so-called flexible rolling, metal strips with periodically alternating defined different thicknesses are produced. The rolled longitudinal thickness profile corresponds in length and thickness, for example, to the subsequent load case of a sheet metal component. The rolling process is to be designed as cold or hot strip rolling. The strip material to be rolled is uncoiled from a coil, rolled and then recoiled again under tension. The corresponding rolling mills may be reversing mills, i.e. after a coil has passed from a first to a second reel device, a next coil may be allowed to pass from the second to the first reel device. After appropriate post-treatment, blanks are separated from this strip material, which are used for the production of components with different wall thicknesses.

In flexible rolling, considerable strip thickness differences of up to 50% and more are achieved in a single rolling pass by changing the roll gap by means of servo-hydraulic or servo-electric positioning means for the working rolls. In case of a change of the roll gap and thus of the outgoing strip thickness, changes of the strip speed occur on the inlet and outlet side due to the condition of volume constancy at the roll gap. Due to these speed changes, the strip tension of the metal strip is also constantly changing. The changes in strip speed and thus in strip tension occur so rapidly at high rolling speeds that the reel devices are not able to maintain constant strip tension at the roll gap by adjusting the reel speeds. Changes in the strip tension have a direct influence on the strip thickness tolerances on the outlet side. In order to improve the strip thickness tolerances, a method is therefore required that enables constant strip tension even over highly variable strip speeds. For this purpose, so-called dancers have been inserted into the strip line for decades, which, in their function as strip storage means, keep the strip tension constant during speed changes.

One way to compensate for the speed variation of the metal strip at relatively low rolling speeds is to change the reel speeds. Here the speed of the reel is regulated depending on the position of the roll gap. If the roll gap opens and a thicker area is rolled, the speed of the reel is increased. If the roll gap is closed and thus the strip speed is reduced process-related, the reel speed is also reduced, as described in CN 101890434 A. The disadvantage of this process is the limitation of the coil weight and the rolling speed. Due to the mass inertia, the reaction time of the system increases with increasing mass. An increase in the mass of the coil leads to a necessary reduction in the rolling speed. On the other hand, an increased rolling speed causes a reduction in the mass of the coil, which increases the non-productive times of the mill.

DE 103 15 357 A1 discloses a rolling mill for rolling metal strip with a first reel device for uncoiling, from which strip with a defined initial strip thickness can be uncoiled, with a roll stand comprising at least two working rolls, between which a roll gap is formed that can be controlled and/or regulated in terms of width, and with a second reel device for coiling, onto which metal strip with a reduced final strip thickness compared with the defined initial strip thickness can be coiled. Further, the rolling mill has first strip storage means comprising a roll arrangement of a plurality of rolls between the first reel device and the roll stand. The rolling mill further comprises second strip storage means comprising a roll arrangement of a plurality of rolls between the roll stand and the second reel device. The rolls of the first strip storage means and the second strip storage means are variable in their position relative to one another for strip storage, the metal strip being guided in each case in the form of an "S" with at least partially superimposed bends. To change the position of the rolls relative to each other, the movement of one of the rolls per strip storage means is hydraulically adjusted so that the "S" is distorted in such a way that the length of the metal strip is changed between an entry and an exit of the respective strip storage means.

From EP 1 121 990 B2 an apparatus for rolling metal strip with periodically variable strip thickness is known, in which a compensating or dancer roll is arranged both between a reel for uncoiling metal strip and the roll stand and between the roll stand and a reel for coiling metal strip. The strip material is looped around the compensating or dancer rolls. The compensating or dancer rolls are force-controlled at a constant circumferential speed of the rolls of the roll stand defining the roll gap in order to apply a desired strip tension, whereby the reels are speed-controlled. The compensating or dancer rolls are adjusted vertically and in a direction perpendicular to the metal strip.

SUMMARY

The teaching of the present disclosure provides an apparatus, a rolling mill and a method for controlling a strip tension in flexible rolling of metal strip with a fast and accurate control of the strip tension in the metal strip is enabled.

According to one aspect the apparatus for controlling a strip tension during flexible rolling of metal strip comprises: a roll arrangement with at least one dancer roll, the position of said dancer roll being adjustable for controlling the strip tension of the metal strip, at least one hydraulic drive coupled to the dancer roll for adjusting the dancer roll, a hydraulic tank for hydraulic fluid, which is connected to the hydraulic drive via a hydraulic supply line, a controllable valve arrangement between the hydraulic tank and the hydraulic drive for controlling the hydraulic drive, a hydraulic pump with which the hydraulic drive is supplied with hydraulic fluid from the hydraulic tank, and at least one hydraulic pressure accumulator for temporarily storing hydraulic fluid previously delivered by the hydraulic pump, the hydraulic pressure accumulator being arranged between the hydraulic pump and the valve arrangement. Here, a pressure sensor is arranged in the hydraulic drive for determining the hydraulic pressure.

The hydraulic pressure can be used to infer the strip tension of the metal strip.

A fast adjustment of the at least one dancer roll cannot be guaranteed by adjusting the delivery rate of the hydraulic pump alone, especially at high rolling speeds, for example above 25 m/min, and when using large coil masses of, for example, 5 to 25 kg/mm strip width at strip widths of 300 to 750 mm. Therefore, the teaching of the present disclosure further provides for a hydraulic pressure accumulator for temporarily storing hydraulic fluid previously delivered by the hydraulic pump, wherein the hydraulic accumulator is disposed between the hydraulic pump and the valve arrangement. From this hydraulic pressure accumulator, a high volume of hydraulic fluid can be made available in the shortest possible time for adjusting the at least one dancer roll, so that small fluctuations in the strip tension, preferably below 35%, are achieved. The hydraulic pressure accumulator should be arranged as close as possible to the hydraulic units for adjusting the dancer roll, so that line losses between the hydraulic pressure accumulator and the adjustment unit for the dancer roll are also kept low.

The hydraulic drive can be, for example, one or more hydraulic cylinders per dancer roll. One double-acting hydraulic cylinder or two single-acting hydraulic cylinders can be used to adjust a dancer roll.

The hydraulic pressure is measured in the hydraulic supply line or in one or more cylinder chambers of the hydraulic cylinder.

Furthermore, it is possible that at least one force sensor, for example a tension load cell, is arranged on at least one roll of the roll arrangement for determining the forces acting from the metal strip on the respective roll or rolls. This means that the strip tension in the metal strip can be inferred directly.

Further, a displacement measuring system may be arranged on the at least one dancer roll for determining the position of the dancer roll. This makes it possible to determine whether the dancer roll is already close to an end position of its adjustment travel in order to be able to adjust the speed of the metal belt if necessary. The speed of the metal strip can be adjusted by changing the reel speed. Changing the speed of the metal strip tends to adjust the position of the dancer roll.

According to one aspect, the hydraulic drive is connected to the hydraulic tank via a return line in a fluid-conducting manner, wherein at least one pulsation damper is arranged in the return line. At high belt speeds, a high frequency of adjustment of the dancer roll is required, resulting in high flow velocities and possibly cavitation in the hydraulic lines. These pressure fluctuations can be reduced by the at least one pulsation damper to prevent damage to the hydraulic system. Here, the at least one pulsation damper is arranged as close as possible to the hydraulic cylinder.

In addition, a compensation tank may be arranged downstream of the at least one pulsation damper to allow further expansion of the hydraulic fluid as close as possible to the hydraulic drive. The flow of the hydraulic fluid, starting from the compensation tank to the hydraulic tank, can then be purely gravity-based, which counteracts further cavitation. A check valve may be located between the compensation tank and the hydraulic tank.

According to an exemplary embodiment, the dancer roll is arranged to be horizontally adjustable. In principle, however, an adjustment direction of the dancer roll deviating from the horizontal direction is also conceivable.

The roll arrangement may comprise at least one further roll in addition to the at least one dancer roll, wherein the at least one dancer roll and the at least one further roll are arranged vertically one above the other such that the metal strip is guided in the form of an S, or as an S-shaped loop.

The teaching of the present disclosure further provides a rolling mill for the flexible rolling of metal strip, wherein the rolling mill comprises: a roll stand with two working rolls, between which a roll gap is formed which is adjustable in width, a first strip guiding unit with a first reel for uncoiling metal strip, a second strip guiding unit with a second reel for coiling rolled metal strip. Furthermore, in at least one of said strip guiding units, an apparatus according to the above-described embodiments is arranged between the respective reel and the roll stand.

According to a further aspect a method for controlling a strip tension during the flexible rolling of metal strip in a rolling mill with an apparatus as described above is provided, wherein the valve arrangement is controlled depending on the strip tension of the metal strip and for the short-term supply of hydraulic fluid, the hydraulic drive is fed at least partially with hydraulic fluid previously stored in the at least one hydraulic pressure accumulator.

The hydraulic pressure is measured in the hydraulic drive, wherein the strip tension in the metal strip is inferred from the hydraulic pressure and the valve arrangement is controlled depending on the determined strip tension.

In addition, the forces acting from the metal strip on a roll of the roll arrangement can be measured, whereby the strip tension in the metal strip is inferred from the determined forces and the valve arrangement is controlled depending on the determined strip tension.

In one embodiment of the method for controlling a rolling mill as described above, the position of the dancer roll of the at least one strip guiding unit can be determined via a displacement measuring system, wherein the speed or rotational speed of the reel of the at least one strip guiding unit is controlled depending on the position of the dancer roll. Hereby the position of the dancer role can be changed tendentially.

In the case of the strip guiding unit between the first reel for uncoiling the metal strip and the roll stand, the speed of the first reel can thereby be increased shortly before a defined first end position of the dancer roll is reached, at which the metal strip length between an entry into the roll arrangement and an exit from the roll arrangement assumes a smallest value. Shortly before reaching a defined second end position of the dancer roll, at which the metal strip length between the entry into the roll arrangement and the exit from the roll arrangement assumes a maximum value, the speed of the first reel can be reduced. This avoids the need to adjust the dancer roll beyond the two end positions and keeps it in a central area as much as possible.

The conditions are reversed for the strip guiding unit between the roll stand and the second reel for coiling the metal strip. That is, shortly before a defined first end position of the dancer roll is reached, at which the metal strip length between an entry into the roll arrangement and an exit from the roll arrangement assumes a maximum value, the speed of the second reel is increased. Shortly before reaching a defined second end position of the dancer roll, at which the metal strip length between the entry into the roll arrangement and the exit from the roll arrangement assumes a smallest value, the speed of the second reel is reduced.

It may further be provided that the roll gap setting of the roll stand is determined, wherein the valve arrangement is controlled in addition to the strip tension of the metal strip in dependence on the roll gap. This enables a pre-control depending on the roll gap setting, which ensures a low reaction time of the system, especially in combination with the control from the determination of the strip tension.

BRIEF SUMMARY OF THE DRAWING

One exemplary embodiment of a rolling mill is explained in more detail below with reference to a drawing.

DESCRIPTION WITH REFERENCE TO THE DRAWING

Figure 1:
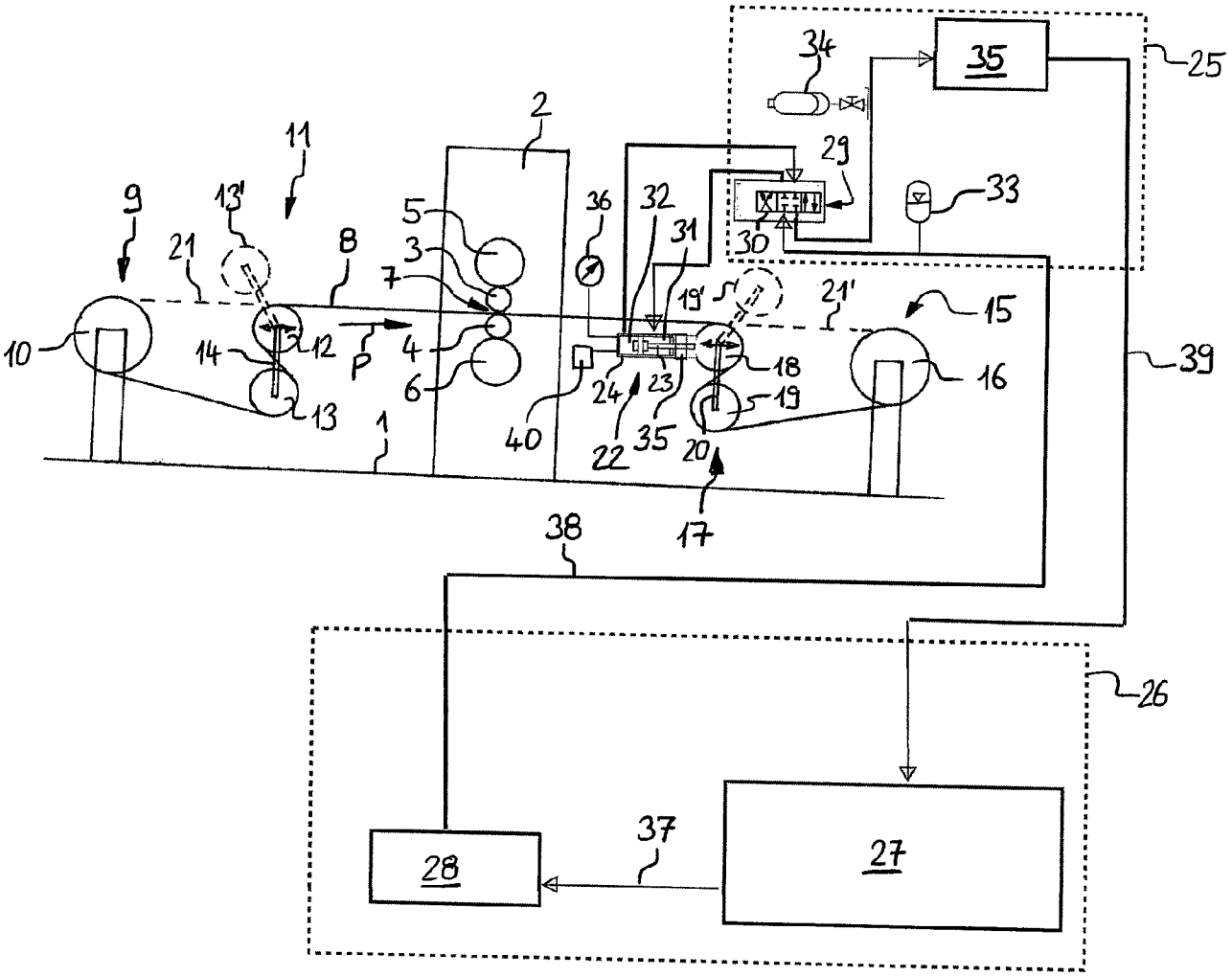
FIG. 1 schematically shows a rolling mill with hydraulic adjustment device in side view.

As seen in FIG. 1, a roll stand 2, in which two superimposed working rolls 3, 4 and two supporting rolls 5, 6 lying in vertical alignment with the working rolls 3, 4, is installed on a foundation 1. An adjustable and controllable roll gap 7 is formed between the working rolls 3, 4, through which a metal strip 8 passes from left to right in a production direction P in the illustration shown. The rolling mill may be a reversing mill in which, after a coil has passed through in the direction of production P, as shown in the FIGURE, a next coil passes through the rolling mill in the opposite direction.

In the embodiment shown, the metal strip 8 comes from a first reel device 9 having a left-turning first reel 10 from which the metal strip 8 is uncoiled over the lower side of the first reel 10. For storing a certain length of the metal strip 8 and for introducing a strip tension into the metal strip 8, the metal strip 8 runs from the first reel device 9 in the direction of production P into a first roll arrangement 11 in the form of a double roll arrangement comprising a movable upper dancer roll 12 and a fixed lower roll 13. A horizontal double arrow indicates that the dancer roll 12 can be moved horizontally in the first roll arrangement 11 in a controlled manner. In principle, other orientations, such as a vertical or oblique adjustment, and other forms of movement, such as a swivel movement, are also conceivable. In the illustrated embodiment, a movement of the dancer roll 12 changes the length of the loop of metal strip 8 between an entry into the first roll arrangement 11 and an exit from the first roll arrangement 11.

The lower, in principle stationary, roll 13 is to be pivoted by means of a rocker 14 from its operating position (solid representation 13) to an insertion position (dashed representation 13') over a strip line 21. The dashed line indicates the insertion position of the stationary roll 13, in which the metal strip 8 can be inserted into the roll stand 2 along the strip line 21, which is also shown dashed. When the metal strip 8 is fixed for reeling, the roll 13 swivels back to its operating position shown with a solid line.

Downstream of the roll stand 2 in the direction of production, and thus to the right of the roll stand 2, a second reel device 15 for coiling the metal strip 8 is shown, which has a left-turning rotating second reel 16 that coils the rolled metal strip 8 over the lower side. Between the roll stand 2 and the second reel device 15 is another second roll arrangement 17 for storing metal strip and applying a strip tension, comprising a movable upper dancer roll 18 and a stationary lower roll 19.

In principle, the first reel 10 and the second reel 16 can be designed left-turning or right-turning, and the metal strip 8 can be uncoiled or coiled from above or from below.

It is indicated by a horizontal double arrow that the dancer roll 18 is displaceable in a controlled manner relative to the stationary roll 19 in the second roll arrangement 17. Again, analogous to the dancer roll 12 of the first roll arrangement 11, it is conceivable that the dancer roll 18 is displaced or pivoted in a different direction. Adjusting the dancer roll 18 of the second roll arrangement 17 changes the length of the loop of metal strip 8 between an entry into the second roll arrangement 17 and an exit from the second roll arrangement 17.

With dashed line, the roll 19 is shown in an insertion position 19' over a strip line 21' pivoted by means of a rocker 20 from its operating position 19, the insertion position serves to insert a beginning of the strip along the strip line 21, again shown with dashed line. When the beginning of the strip is fixed on the second reel 16, the roll 19 swivels back into its operating position 19 shown solid.

Thus, by adjusting the dancer rolls 12, 18, the tensile force within the metal strip 8 can be varied. Additional tensile increase results when at least one of the rolls 12, 13, 18, 19 is provided with braking means and/or driving means not shown.

In FIG. 1, a hydraulic drive for the dancer roll 18 of the second roll arrangement 17 is schematically shown, wherein the hydraulic drive comprises a double-acting hydraulic cylinder 22. The dancer roll 18 is connected to a piston rod 23 adjustably disposed in a cylinder 24 of the hydraulic cylinder 22, and is adjustable in position by the piston rod 23. The hydraulic cylinder 22 is actuated by a hydraulic actuating arrangement 25.

The dancer roll 12 of the first roll arrangement 11 is adjustable, as the dancer roll 18 of the second roll arrangement 17, via a hydraulic cylinder and a hydraulic actuating arrangement, the hydraulic cylinder and the hydraulic actuating arrangement for the dancer roll 12 of the first roll arrangement 11 not being shown for clarity. Therefore, the hydraulic actuating arrangement 25 for the second roll arrangement 17 will also be described below as representative of the hydraulic actuating arrangement for the first roll arrangement 11.

A hydraulic tank 27, in which hydraulic fluid is stored, is located in a mill cellar 26 below the level of the foundation 1. Furthermore, a hydraulic pump 28 is arranged in the mill cellar 26. The hydraulic pump 28 is fluidly connected to the hydraulic tank 27 via a hydraulic line 37 and delivers hydraulic fluid from the hydraulic tank 27 towards the hydraulic cylinder 22. In principle, multiple hydraulic pumps 28 may also be provided.

The hydraulic cylinder 22 is in turn fluidly connected to the hydraulic tank 27 on the outlet side.

For controlling the hydraulic cylinder 22, a controllable valve arrangement 29 is arranged between the hydraulic cylinder 22 and the hydraulic pump 28, which is fluidly connected to the hydraulic pump 28 via a supply line 38 and which comprises a hydraulic servo valve 30. The valve arrangement is further connected to the hydraulic tank 27 by a return line 39. The servo valve 30 can be controlled such that the supply line 38 from the hydraulic pump 28 is blocked, just as the return line 39 from the hydraulic cylinder 22 to the hydraulic tank 27 can be blocked. Further, the supply line 38 may optionally be fluidly connected to a first cylinder chamber 31 or a second cylinder chamber 32 of the hydraulic cylinder 22, with the return line 39 to the hydraulic tank 27 being connected to the respective other of the two cylinder chambers 32, 31. Thus, the piston rod 23 can be adjusted in the direction of the indicated double arrow.

In order to enable the hydraulic cylinder 22 and thus the dancer roll 18 to be adjusted as quickly as possible, a hydraulic pressure accumulator 33 is arranged in the supply line 38 between the hydraulic pump 28 and the valve arrangement 29 in order to temporarily store hydraulic fluid previously delivered by the hydraulic pump 28 and to deliver it to the hydraulic cylinder 22 as required. In this case, the hydraulic pressure accumulator 33 is preferably arranged at a level of the foundation 1 or above and, moreover, is provided as close as possible to the hydraulic cylinder 22 in order to avoid line losses. In principle, it is also conceivable that several hydraulic pressure accumulators 33 are arranged in the supply line 38.

A pulsation damper 34 is arranged in the return line 39 between the valve arrangement 29 and the hydraulic tank 27, although in principle several pulsation dampers 34 may be provided. The pulsation damper 34 serves to equalize the pressure fluctuations in the return line from the valve arrangement 29 to counteract cavitations. In addition, a compensation tank 35 is provided between the pulsation damper 34 and the hydraulic tank 27 to ensure that hydraulic fluid can flow from the compensation tank 35 into the hydraulic tank 27 without pressure so that cavitation cannot occur in this region of the hydraulic line. The pulsation damper 34 is arranged as close as possible to the hydraulic cylinder 22. In principle, however, it is also conceivable that no pulsation damper is provided in the return line 39.

A force sensor in the form of a tension load cell 35 is provided between the hydraulic cylinder 22 and the coupling thereof to the dancer roll 18. This can be used to determine the tensile and compressive forces occurring between the hydraulic cylinder 22 and the dancer roll 18, so that the strip tension within the metal strip 8 can be inferred from this.

Further, the hydraulic cylinder 22 includes a pressure sensor 36 for determining the hydraulic pressure within the second cylinder chamber 32. This determined pressure can also be used to infer the strip tension in the metal strip 8. The pressure sensor may also be located in the first cylinder chamber 31. Alternatively, multiple pressure sensors may be provided, for example one for the first cylinder chamber 31 and one for the second cylinder chamber 32 or for the hydraulic supply lines to the hydraulic cylinder 22.

The hydraulic cylinder 22 is further provided with an integrated displacement measuring system 40, which can be used to determine the position of the dancer roll 18. The displacement measuring system 40 may alternatively be provided on another component that is moved with the dancer roll 18. The position of the dancer roll 18 makes it possible to determine whether the dancer roll 18 is already in an end position of its adjustment travel, in order to be able to adjust the speed of the metal strip 8 if necessary. By changing the speed of the metal strip 8, for example by changing the reel speed, the position of the dancer roll 18 can be changed. If the reel speed of the second reel 16 is increased, more metal strip 8 tends to be discharged from the second roll arrangement 17, so that a less long loop of metal strip 8 has to be stored in the second roll arrangement 17 to achieve a constant strip tension. In the embodiment shown, this is achieved by moving the dancer roll 18 to the left. Thus, when the dancer roll 18 of the second roll arrangement 17 is in an end position in the illustration on the right, the speed of the second reel 16 must be increased to tend to move the dancer roll 18 back to a center position. When the dancer roll 18 has reached a left end position, the speed of the second reel 16 must be reduced accordingly.

LIST OF REFERENCE NUMBERS

1 Foundation
2 Roll stand
3 Working roll
4 Working roll
5 Supporting roll
6 Supporting roll
7 Roll gap
8 Metal strip
9 First reel device
10 First reel
11 First roll arrangement
12 Dancer Roll
13 Roll
14 Rocker
15 Second reel device
16 Second reel
17 Second roll arrangement
18 Dancer Roll
19 Roll
20 Rocker
21 Strip line
22 Hydraulic cylinder
23 Piston rod
24 Cylinder
25 Actuating arrangement
26 Mill cellar
27 Hydraulic tank
28 Hydraulic pump
29 Valve arrangement
30 Servo valve
31 First cylinder chamber
32 Second cylinder chamber
33 Hydraulic pressure accumulator
34 Pulsation damper
35 Tension load cell
36 Pressure sensor
37 Hydraulic line
38 Supply line
39 Return line
40 Displacement measuring system

The invention claimed is:

1. A method for controlling a strip tension during flexible rolling of metal strip in a rolling mill with a dancer roll that is adjusted with a hydraulic drive, and further having a controllable valve arrangement disposed between a hydraulic pump and the hydraulic drive, and at least one hydraulic pressure accumulator arranged between the hydraulic pump and the valve arrangement, comprising the following steps:

measuring a hydraulic pressure at the hydraulic drive, determining the strip tension in the metal strip based on the measured hydraulic pressure at the hydraulic drive;

controlling the valve arrangement depending on the determined strip tension of the metal strip, storing hydraulic fluid in the at least one hydraulic pressure accumulator, feeding, at least partially, the hydraulic fluid previously stored in the at least one hydraulic pressure accumulator to the hydraulic drive for a short-term supply of hydraulic fluid, determining a position of the dancer roll of at least one strip guiding unit for coiling or uncoiling the metal strip, and varying a speed of a reel of the at least one strip guiding unit depending on the position of the dancer roll.

2. A method for controlling a strip tension during flexible rolling of metal strip in a rolling mill with a dancer roll that is adjusted with a hydraulic drive, and further having a controllable valve arrangement disposed between a hydraulic pump and the hydraulic drive, and at least one hydraulic pressure accumulator arranged between the hydraulic pump and the valve arrangement, comprising the following steps:

measuring a hydraulic pressure at the hydraulic drive, determining the strip tension of the metal strip based on the measured hydraulic pressure at the hydraulic drive, controlling the valve arrangement depending on the strip tension of the metal strip, storing hydraulic fluid in the at least one hydraulic pressure accumulator, feeding, at least partially, the hydraulic fluid previously stored in the at least one hydraulic pressure accumulator to the hydraulic drive for a short-term supply of hydraulic fluid, determining a roll gap setting of a roll stand adjacent the roll arrangement; and controlling the valve arrangement in addition to the strip tension of the metal strip based on the roll gap.

3. An apparatus for controlling a strip tension during flexible rolling of metal strip, the apparatus comprising:

a roll arrangement with at least one dancer roll, a position of said dancer roll being adjustable for controlling the strip tension of the metal strip, at least one hydraulic drive coupled to the dancer roll for adjusting the dancer roll, a hydraulic tank being fluidly connected to the hydraulic drive via a hydraulic supply line delivering hydraulic fluid to the hydraulic drive from the hydraulic tank and via a hydraulic return line returning hydraulic fluid from the hydraulic drive to the hydraulic tank, a hydraulic pump for supplying hydraulic fluid from the hydraulic tank to the hydraulic drive, a controllable valve arrangement disposed in the hydraulic supply line between the hydraulic pump and the hydraulic drive for controlling the hydraulic drive and disposed in the hydraulic return line between the hydraulic drive and the hydraulic tank, a pulsation damper arranged in the hydraulic return line between the controllable valve arrangement and the hydraulic tank, at least one hydraulic pressure accumulator for temporarily storing hydraulic fluid previously delivered by the hydraulic pump, the hydraulic pressure accumulator being arranged between the hydraulic pump and the valve arrangement, and a pressure sensor for determining a hydraulic pressure arranged in the hydraulic drive.

4. The apparatus according to claim 3, further comprising a compensation tank arranged downstream of the pulsation damper.

* * * * *